US008523283B2

(12) United States Patent
Lee

(10) Patent No.: US 8,523,283 B2
(45) Date of Patent: Sep. 3, 2013

(54) METHOD AND APPARATUS FOR DOUBLE SLING CHAIR

(75) Inventor: Clifton Shao-ming Lee, Hillsborough, CA (US)

(73) Assignee: Nomark Industries Company Limited, Hong Kong (CN)

( * ) Notice: Subject to any disclaimer, the term of this patent is extended or adjusted under 35 U.S.C. 154(b) by 200 days.

(21) Appl. No.: 13/136,615

(22) Filed: Aug. 5, 2011

(65) Prior Publication Data

US 2012/0248844 A1 Oct. 4, 2012

Related U.S. Application Data

(63) Continuation-in-part of application No. 13/065,731, filed on Mar. 28, 2011.

(51) Int. Cl.
*A47C 7/40* (2006.01)

(52) U.S. Cl.
USPC ..... 297/440.11; 297/284.2; D6/376

(58) Field of Classification Search
USPC ..... 297/284.2, 440.11, 452.1, 452.18, 297/463.2; D6/376
See application file for complete search history.

(56) References Cited

U.S. PATENT DOCUMENTS

| | | | | | |
|---|---|---|---|---|---|
| D18,833 | S | * | 1/1889 | Matzen | D6/335 |
| D180,523 | S | * | 6/1957 | Maddox | D6/380 |
| 3,289,220 | A | * | 12/1966 | Grimshaw | 297/452.56 |
| 3,844,612 | A | * | 10/1974 | Borggren et al. | 297/451.3 |
| 6,494,540 | B1 | * | 12/2002 | Tornero | 297/440.1 |
| 6,511,562 | B1 | * | 1/2003 | Coffield | 297/440.11 |
| 6,585,323 | B2 | * | 7/2003 | Gaylord et al. | 297/440.11 |
| 6,779,849 | B1 | * | 8/2004 | Harper et al. | 297/452.13 |
| 8,317,270 | B2 | * | 11/2012 | Tseng | 297/452.2 |
| 8,403,421 | B2 | * | 3/2013 | Wang | 297/440.11 |

* cited by examiner

*Primary Examiner* — Peter Brown
(74) *Attorney, Agent, or Firm* — Daniel Hopen

(57) ABSTRACT

Some embodiments of the present invention provide a method and apparatus for a novel double sling chair. The double sling chair simplifies the manufacture of sling chairs affording efficient and speedy construction. The double sling chair comprises a chair frame having a back section with an upper rail and a lower cross member, a decorative cross member, and a seat section, a seat panel coupled to the seat section of the chair frame, a first fabric back panel having length is coupled to the upper rail and the decorative cross member without having to thread the first fabric back panel to the decorative cross member, a second fabric back panel having length is coupled to the lower cross member and the decorative cross member without having to thread the second fabric back panel to the decorative cross member to form a back rest for the back section.

9 Claims, 8 Drawing Sheets

10

METHOD AND APPARATUS FOR DOUBLE SLING CHAIR

RELATED APPLICATION

This is a continuation-in-part of U.S. Ser. No. 13/065,731 filed Mar. 28, 2011 (HMSC110328) which is incorporated herein by reference.

BACKGROUND

1. Technical Field

This disclosure generally relates to sling chairs, and more particularly to a double-sling chair wherein insertion of the sling fabric is greatly simplified.

2. Related Art

Conventional outdoor furniture of the type intended for use on decks and patio are very popular. Manufacturers of outdoor patio furniture are constantly called upon to offer new innovative designs that provide practical, comfortable products to the consumer. Manufacturers on one hand are interested in offering the innovative designs, but are also interested in reducing manufacturing cost by simplifying and reducing the time to manufacture the outdoor patio furniture.

As the outdoor patio furniture industry has developed, a popular design for chairs, loungers, and the like is a supporting web that is suspended between a frame of a chair to support the user of the chair. These supporting web style chairs are commonly known as sling chairs. Although the sling chair construction arose since it is easier and less expensive to construct the sling and the chair frame separately, however, it has become apparent that there are short comings to the conventional construction and manufacture of sling-style chairs.

What is needed is a sling chair that simplifies conventional sling chair construction and reduces waste and effort associated with the manufacture and construction of sling chairs while still offering attractive designs with many variations.

SUMMARY OF INVENTION

A method and apparatus for a novel double sling chair are disclosed which overcome disadvantages of previous sling chair construction. The novel double sling chair construction reduces waste associated with ripping sling fabric panels and mis-fitting sling fabric panels. The manufacturing steps are simplified by reducing the incidence of having to thread the fabric panels along the length of the sling fabric groove. Instead of having to attach the sling fabric early in the construction, the sling fabric can be attached near the end of construction when the entire frame of the chair is completed which greatly reduces the incidence of the sling fabric being cut or marred. Accordingly, the double sling chair comprises a chair frame, a seat panel coupled to the chair frame, a first fabric back panel having length and first and second terminating loops at opposing ends with a first rod inserted through the first terminating loop and a second rod inserted through the second terminating loop for attaching the fabric back panel to the chair frame, and a second fabric back panel having length and first and second terminating loops at opposing ends with a first rod inserted through the first terminating loop and a second rod inserted through the second terminating loop for attaching the fabric back panel to the chair frame wherein the chair frame includes a decorative cross member having an upper back center sling rail and a lower back center sling rail, the upper back center sling rail configured to forceably receive the first rod and the first terminating loop of the first fabric panel and the lower back center sling rail configured to forceably receive the first rod and the first terminating loop of the second fabric panel, an upper back cross member having a back top sling rail with an interior side configured to slidably receive the second rod and the second terminating loop of the first fabric panel wherein the back top sling rail is separate from the upper back cross member and configured to securely attach to the upper back cross member to form a section of a back rest, and a lower back cross member having a lower back sling rail having an interior side configured to slidably receive the second rod and the second terminating loop of the second fabric panel wherein the lower back sling rail is separate from the lower back cross member and configured to securely attach to the lower back cross member forming another section of the back rest.

In accordance to another embodiment of the present invention, the upper back cross member is configured with screw threads and receives a screw that secures the back top sling rail to the upper back cross member of the chair frame.

In accordance to another embodiment of the present invention, the first fabric back panel is tensioned as the screw is tightened against the upper cross member.

DETAILED DESCRIPTION

Figure 1:
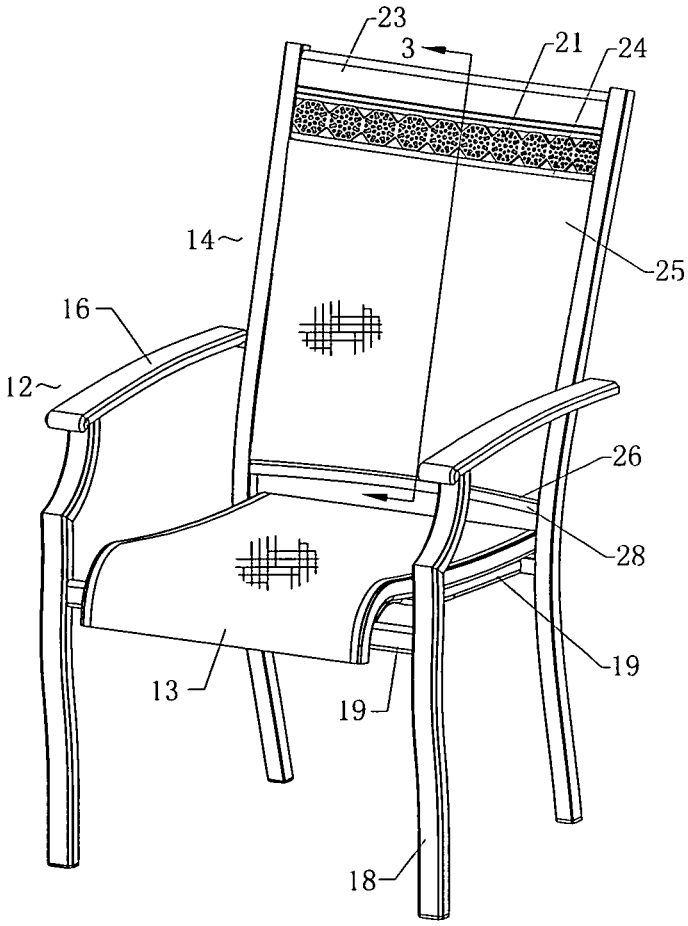
FIG. 1 illustrates a single sling chair in accordance with an embodiment of the present invention.

FIG. 1 illustrates a single sling chair 10 in accordance with an embodiment of the present invention. The single sling chair 10 includes a chair frame 12, a seat section 13, and a back section 14. The general construction of the single sling chair is conventional and well known to those skilled in the art of making patio chairs. A detailed discussion of how of the chair is constructed will detract from the spirit of the present invention. Therefore, a terse discussion of the general construction of the chair is given. Essentially, the chair frame is formed by attaching symmetrical halves of the chair frame that include an arm rest 16, legs 18 with cross supports 19. The seat section 13 is attached to the chair frame 12. The back support 14 includes a decorative cross member 21 and a cross support member 23 to not only give the back support decorative appeal but also added strength. In accordance to a present embodiment, the seat section 13 and the back section 14 are covered with fabric panels. The fabric panel of the seat section 13 is covered using conventional construction. However, the fabric panel of the back section is covered using a novel single sling construction. The back section 14 includes an upper rail 24, a sling fabric 25, a lower rail 26, and lower back cross member 28. The sling fabric 25 is of conventional construction consisting of a fabric back panel having a length and terminating loops at opposing ends and rods inserted into the loops for attaching the fabric back panel.

Figure 2:
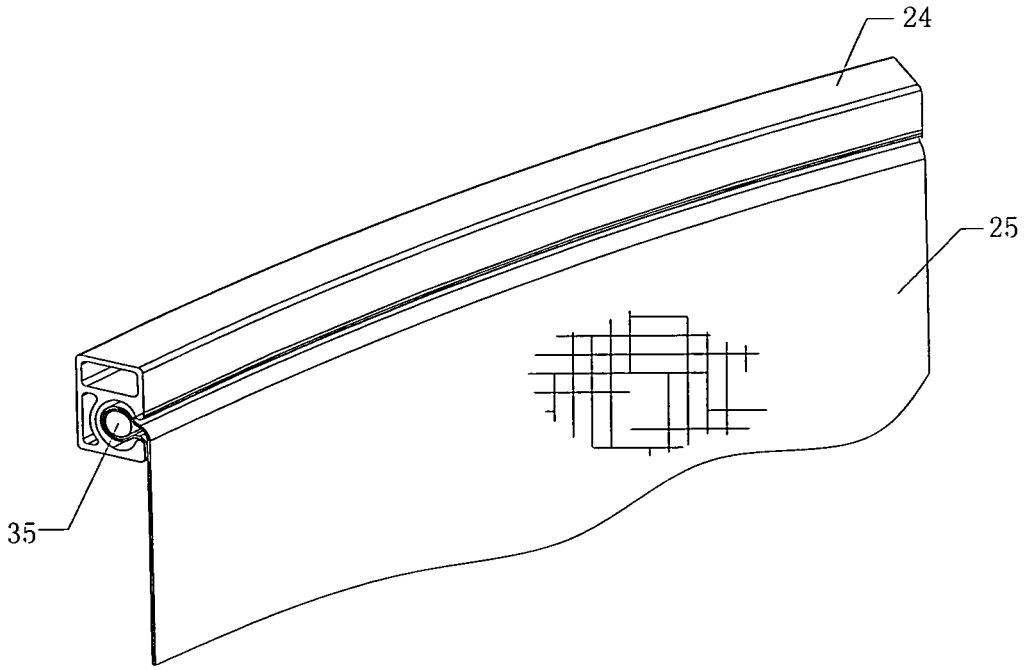
FIG. 2 illustrates an upper rail with an upper end of a sling assembly assembled into an interior side of the upper rail in accordance with an embodiment of the present invention.

FIG. 2 illustrates the upper rail 24, the sling fabric 25 with an upper rod 35 inserted into the sling fabric terminating loop and fitted into an interior side of the upper rail 24. The interior side of the upper rail 24 is constructed to receive and secure the upper rod 35 of the sling fabric 25. In accordance with an embodiment of the present invention, the interior side of the upper rail 24 is configured to flex in order to receive the upper rod 35. In other words, the upper rod 35 is pressed or forced into the interior side of the upper rail 24 with an aid of a small pry device such as a screw driver, pry bar, or the like. Essentially, no threading or sliding is used to insert the upper rod 35. The entire upper rod 35 is aligned with the length of the interior side of the upper rail 24 and is pressed or forced into the interior side of the upper rail 24 with an aid of a pry instrument, and there is no threading motion that is used to assemble the upper rod 35. Manufacture of the single sling chair 10 is greatly simplified by not having to thread or slide the upper rod 35 into the interior side of the upper rail 24 from one end of the upper rod 35. Sling fabric 25 can often rip during the threading or sliding process of the upper rod 35 into the interior side of the upper rail 24. Using the present embodiment of inserting the upper rod 35 directly into the interior side not only saves time but reduces the likelihood of ripping the fabric during installation. Instead of attaching the sling fabric early during construction, the entire frame of the chair can be constructed and attaching the sling fabric can be one of the last finishing step further reducing the likelihood of damage or soiling of the sling fabric.

Figure 3:
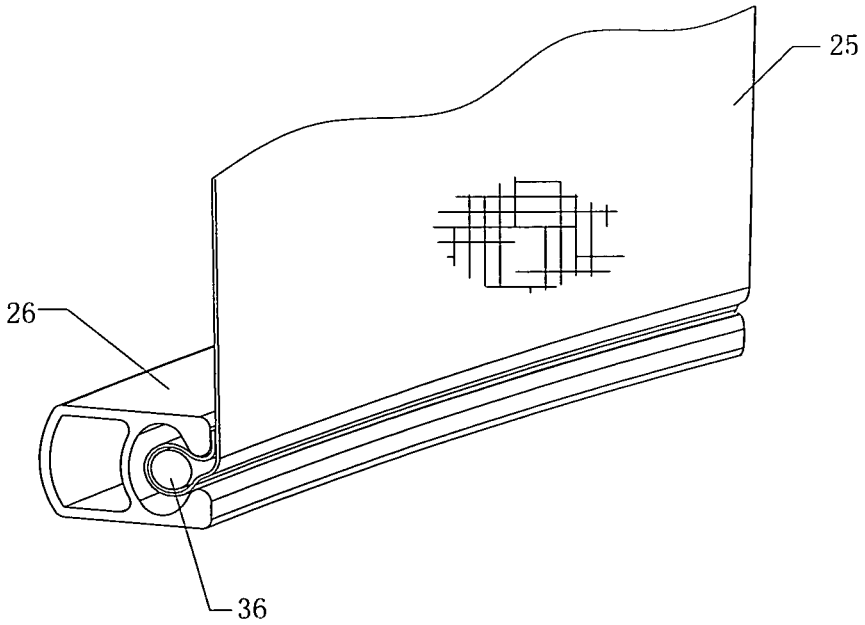
FIG. 3 illustrates a lower rail with a lower end of the sling assembly assembled into an interior side of the lower rail in accordance with an embodiment of the present invention.

FIG. 3 illustrates the lower rail 26, the sling fabric 25 with a lower rod 36 inserted into the sling fabric terminating loop and fitted into an interior side of the lower rail 26. Contrary to the interior side of the upper rail 24, the interior side of the lower rail 26 can not be flexed to insert the lower rod 36 into the interior side of the lower rail 26. Rather, the lower rod 36 is threaded into the interior side of the lower rail 26 using conventional sling construction technique. Since the lower rail 26 is separate and detached from the chair frame, threading or sliding the lower rod 36 into the interior side of the lower rail 26 from either end of the lower rail 26 is simplified and can be accomplished with rather ease.

Figure 4:
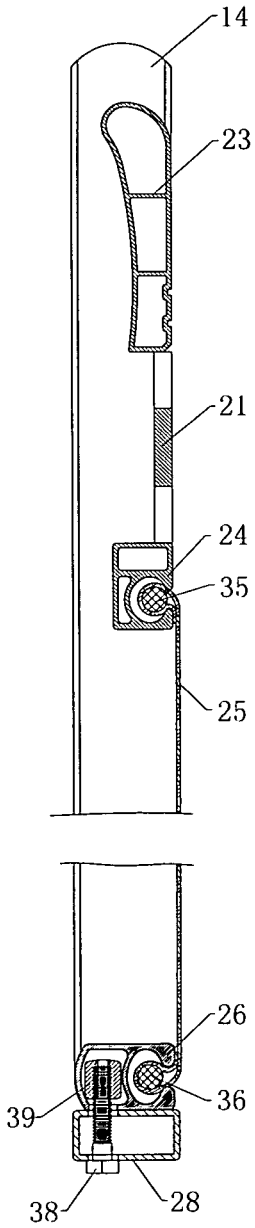
FIG. 4 illustrates an exemplary cut-out view of the chair back taken along line 3-3 of FIG. 1.

FIG. 4 illustrates a cutout taken along line 3-3 of FIG. 1. The upper back support 14 is shown with the cross support member 23, the decorative cross member 21, the upper rail 24 having the upper rod 35 assembled into the interior side of the upper rail 24, sling fabric 25, the lower rail 26 having the lower rod 36 assembled into the interior side of the lower rail 26, the lower back cross member 28, threaded screw/bolt 38, and threads 39. The lower rail 26 has a threaded hole 39 for receiving the threaded screw/bolt 38. The threaded screw 38 is screwed into the threaded hole 39 for attaching the lower rail 26 to the lower back cross member 28. As the threaded screw 38 is tightened, the sling fabric 25 tension can be adjusted. Accordingly, the present embodiment of the single sling chair simplifies the construction of the sling fabric back panel. For example, the entire chair frame can be assembled prior to assembly of the sling fabric back. The assembly of the sling fabric back is simplified by not having to thread the upper rod 35 including the sling fabric 25 into the interior side of the upper rail 24. According to an embodiment of the present embodiment, there is insufficient space to thread/slide the upper rod 35 into the interior side of the upper rail 24. By limiting the space and protrusions of the chair construction, more aesthetically appealing designs of sling style chair can be constructed. In addition, using the threaded screw 38 to attach the lower rail 26 with the lower rod 36 assembled to the interior side of the lower back cross member 28 enables tensioning and adjustment of the sling fabric which reduces waste during manufacturing when the sling fabric is not exactly the correct length. Conventional sling chair construction offers very little if any adjustment to the tension of the sling fabric.

Figure 5:
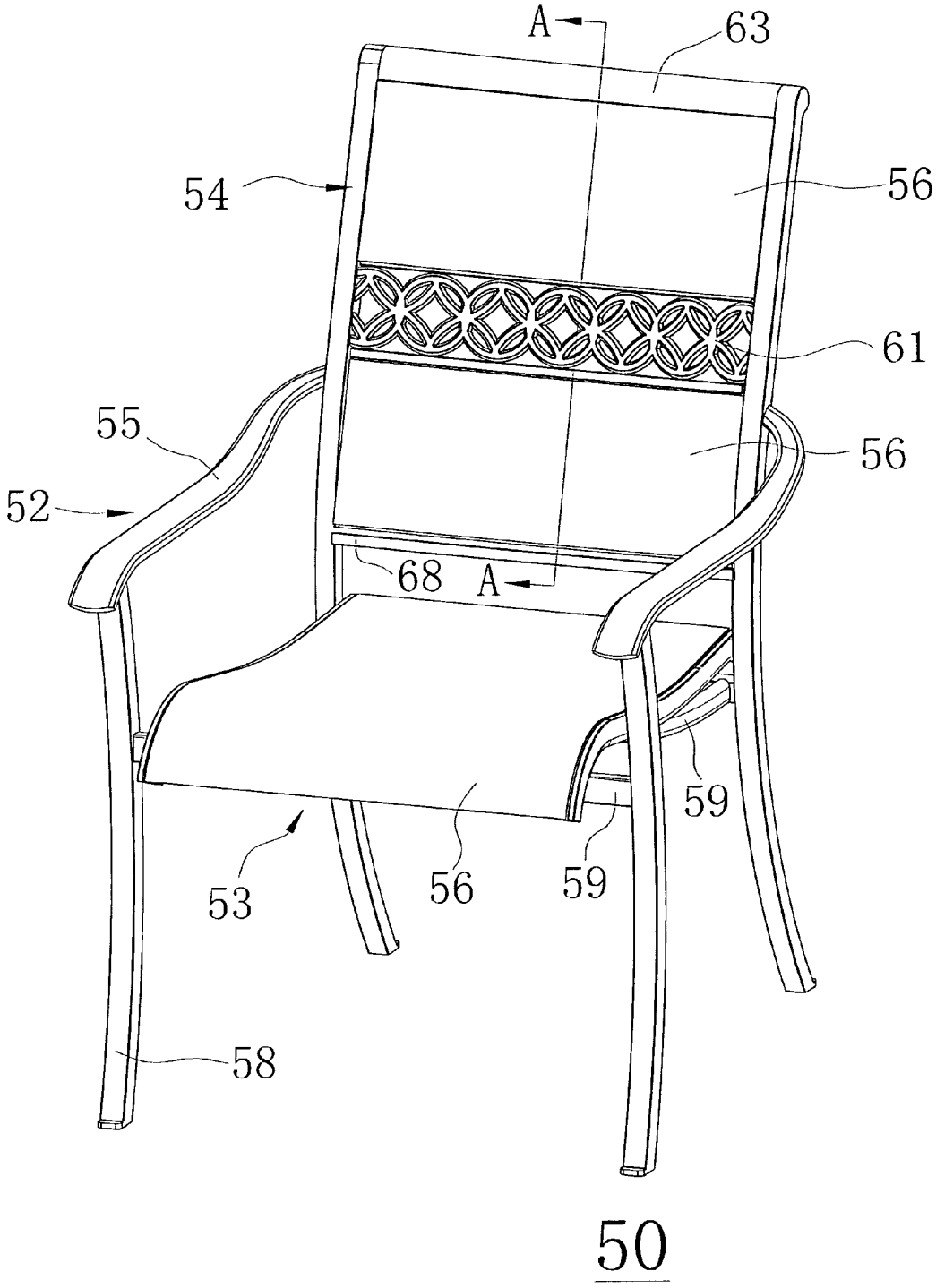
FIG. 5 illustrates a double sling chair in accordance with an embodiment of the present invention.

FIG. 5 illustrates a double sling chair 50 in accordance with an embodiment of the present invention. The double sling chair 50 includes a chair frame 52, a seat section 53, and a back section 54. The general construction of the double sling chair is conventional and well known to those skilled in the art of making patio chairs. A detailed discussion of how of the chair is constructed will detract from the spirit of the present invention. Therefore, a terse discussion of the general construction of the chair is given. In accordance to an embodiment of the present invention, the chair frame 52 is formed by attaching symmetrical halves of the chair frame that include an arm rest 55, legs 58 with cross supports 59. The seat section 53 is attached to the chair frame 52. The back support 54 includes a decorative cross member 61 and an upper back cross member 63 to not only give the back support decorative appeal but also added strength. In accordance to a present embodiment, the seat section 53 and the back section 54 are covered with fabric panels 56. The fabric panels are constructed using durable man-made materials that are weather resistant and strong. The fabric panel of the seat section 53 is covered using conventional construction. However, the fabric panels of the back section are covered using a novel double sling construction. The back section 54 includes the upper back cross support 63, sling fabrics 56, decorative cross member 61 which includes upper back center sling rail 64 (not shown) and lower back center sling rail 65 (not shown), and lower back cross member 68. The sling fabrics 56 is of conventional construction consisting of a fabric back panel having a length and terminating loops at opposing ends and rods inserted into the loops for attaching the fabric back panel.

Figure 6:
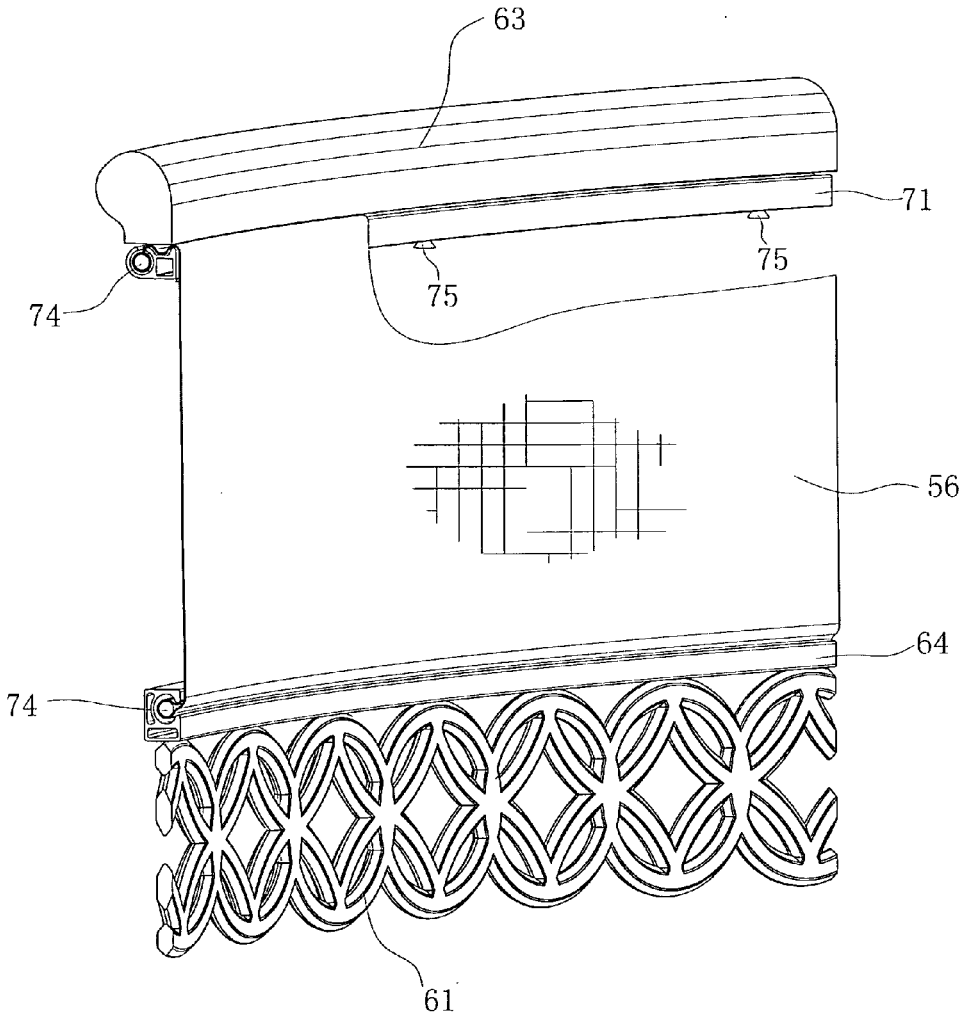
FIG. 6 illustrates a fabric panel attached between an upper back center sling rail of a decorative cross member and a back top sling rail of an upper back cross member in accordance to an embodiment of the present invention.

FIG. 6 illustrates the decorative cross member 61 with the upper back center sling rail 64. A first end of the sling fabric 56 with a rod 74 is inserted into the sling fabric terminating loop and fitted into an interior side of the upper back center sling rail 64. In accordance with an embodiment of the present invention, the interior side of the upper back center sling rail 64 is configured to flex in order to receive the rod 74. In other words, the rod 74 is pressed or forced into the interior side of the upper back center sling rail 64 with an aid of a small pry device such as a screw driver, pry bar, or the like. Essentially, no threading or sliding is used to insert the rod 74. The entire rod 74 is aligned with the length of the interior side of the upper back center sling rail 64 and is pressed or forced into the interior side of the lower back center sling rail 65 with an aid of a pry instrument, and there is no threading motion that is used to assemble the rod 74. Manufacture of the single sling chair 50 is greatly simplified by not having to thread or slide the rod 74 into the interior side of the upper back center sling rail 64 from one end of the rod 74. Sling fabric 56 can often rip during the threading or sliding process of the rod 74 into the interior side of the upper back center sling rail 64. Using the present embodiment of inserting the rod 74 directly into the interior side not only saves time but reduces the likelihood of ripping the fabric during installation. Instead of attaching the sling fabric early during construction, the entire frame of the chair can be constructed and attaching the sling fabric can be one of the last finishing step further reducing the likelihood of damage or soiling of the sling fabric. Referring to FIG. 6, the upper back cross member 63 is shown with a back top sling rail 71 with the sling fabric 56 having an upper rod 74 inserted into the sling fabric terminating loop and fitted into an interior side of the back top sling rail 71. The interior side of the back top sling rail 71 is constructed to receive and secure the rod 74 of the sling fabric 56 against the upper back cross member 63. Screws 75 are inserted through the back top sling rail 71 and are screwed into the upper back cross member 63 to secure the rod 74, sling fabric 56, and the back top sing rail 71 to the upper back cross member 63.

Figure 7A:
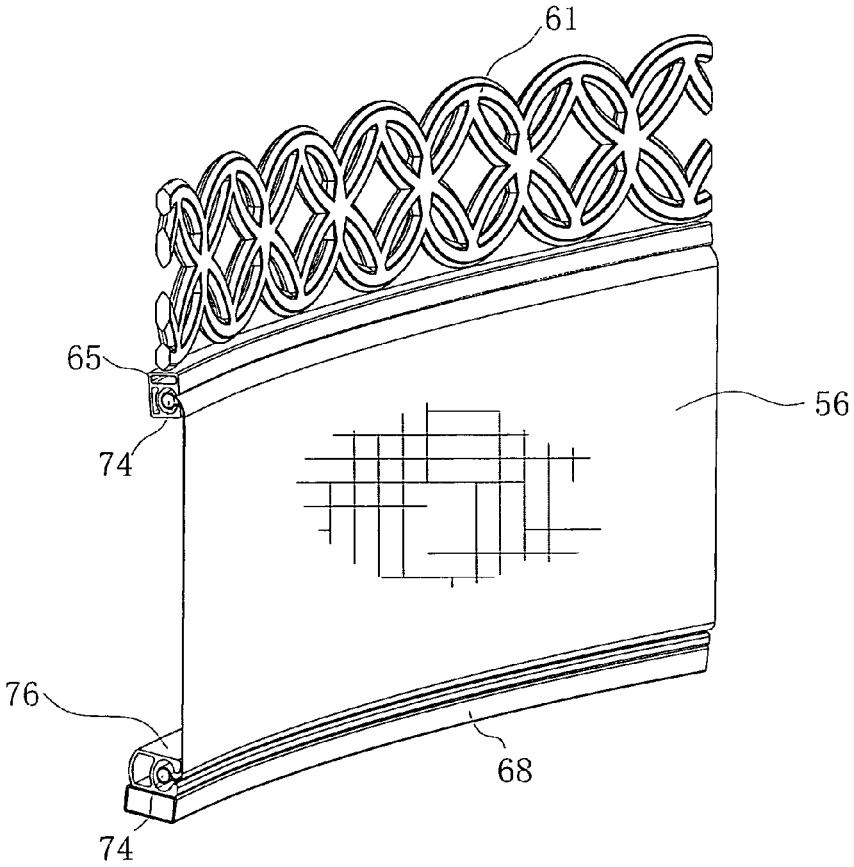
FIG. 7A-7B illustrates a fabric panel attached between a lower back center sling rail of a decorative cross member and a back bottom sling rail of an lower back cross member in accordance to an embodiment of the present invention.

FIG. 7A illustrates the decorative cross member 61 with the lower back center sling rail 65. A first end of the sling fabric 56 with a rod 74 is inserted into the sling fabric terminating loop and fitted into an interior side of the lower back center sling rail 65. Similarly configured as the upper back center sling rail 64, the interior side of the upper back center sling rail 64 is configured to flex in order to receive the rod 74. In other words, the rod 74 is pressed or forced into the interior side of the lower back center sling rail 65 with an aid of a small pry device such as a screw driver, pry bar, or the like. Essentially, no threading or sliding is used to insert the rod 74. The lower back cross member 68 is shown with a lower back sling rail 76 with the sling fabric 56 having a rod 74 inserted into the sling fabric terminating loop and fitted into an interior side of the lower back sling rail 76. The interior side of the lower back sling rail 76 is constructed to receive and secure the rod 74 of the sling fabric 56 against the lower back cross member 68.

Figure 7B:
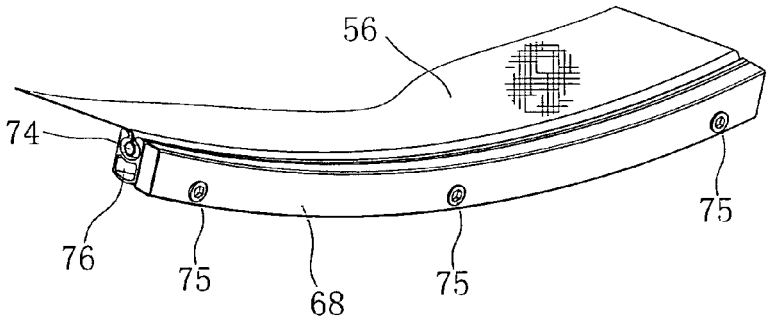

FIG. 7B illustrates screws 75 are inserted through the lower back sling rail 76. The screws 75 are screwed into the lower back sling rail 76 to secure the rod 74, sling fabric 56, and the lower back sling rail 76 to the lower back cross member 68.

Figure 8:
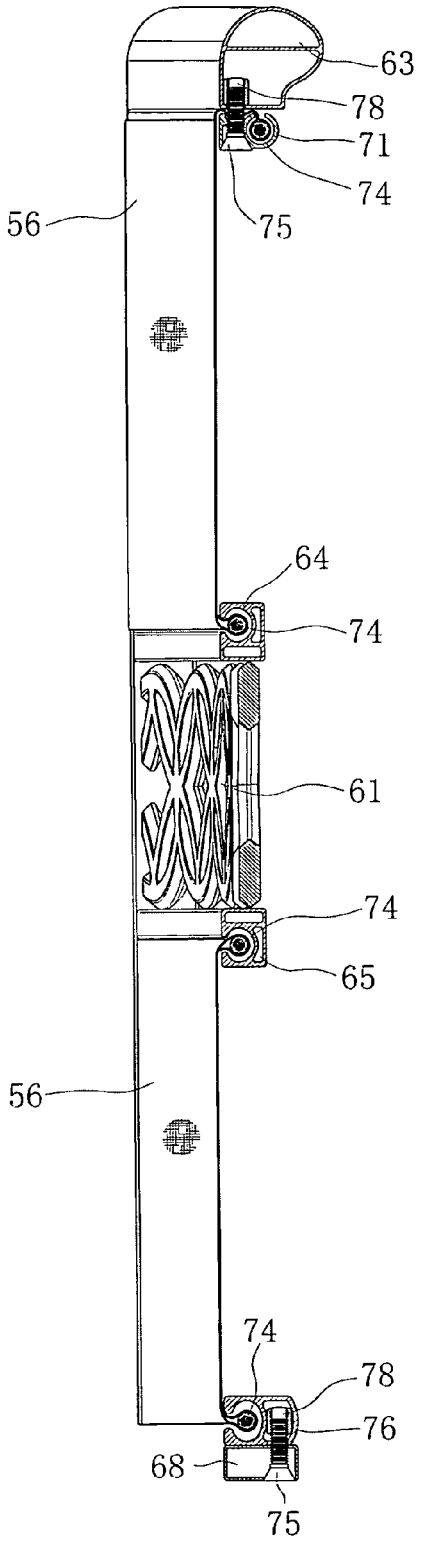
FIG. 8 illustrates an exemplary cut-out view of the chair back taken along line A-A of FIG. 5.

FIG. 8 illustrates a cross-sectional view of the back section 54 of the double sling chair 50 taken alone line A-A rotated approximately 20 degrees about the line A-A. The back section 54 shows the upper back cross member 63, thread block 78, back top sling rail 71, rod 74, screw 75, sling fabric 56, upper back center sling rail 64, decorative cross member 61, rod 74, lower back center sling rail 65, sling fabric 56, lower back sling rail 76 having a thread block 76, screw 75, and lower back cross member 68. The upper back cross member 63 includes a thread block 78 that is configured to receive a threaded screw 75. The threaded screw 75 secures the back top sling rail 71 having the rod 74, sling fabric 56 against the upper back cross member 63. The other end of the sling fabric 56 and the rod is attached to the interior side of the upper back center sling rail 64. As the threaded screw 75 is tightened, the sling fabric 56 tension can be adjusted. Similarly, another sling fabric 56 having a rod 74 inserted into the sling fabric terminating loop is inserted into the interior side of the lower back center sling rail 65. The other end of the sling fabric 56 having a rod 74 inserted into the sling fabric terminating loop is inserted into an interior side of the lower back sling rail 76. The lower back sling rail 76 includes a thread block 78 configured to receive a threaded screw 75 that secures the lower back sling rail 76 assembly which includes the sling fabric 56 and rod 74 inserted into the sling fabric termination loop to the lower back cross member 68. As the threaded screw 75 is tightened, the sling fabric 56 tension can be adjusted.

The present novel double sling invention is susceptible to minor variations and modifications that may be introduced without departing from the inventive concept. For example, the fabric seat and seat back panel could be switched with the fabric seat incorporating the novel double sling construction.

It is further appreciated that designation of furniture as fitting into categories such as chairs, lounges, and other separate and distinct varieties may be inadequate. For example, patio furniture as opposed to furniture designs may show no clear delineation separating the two categories. Moreover, alternative configurations may be within the spirit of the invention if the frame were modified resulting in furniture that can be regarded as a cot, bed, as well as a chair, lounge, sofa, or similar furniture.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. A double sling chair comprising:

a chair frame;

a seat panel coupled to the chair frame;

a first fabric back panel having length and first and second terminating loops at opposing ends with a first rod inserted through the first terminating loop and a second rod inserted through the second terminating loop for attaching the fabric back panel to the chair frame; and a second fabric back panel having length and first and second terminating loops at opposing ends with a first rod inserted through the first terminating loop and a second rod inserted through the second terminating loop for attaching the fabric back panel to the chair frame wherein the chair frame includes:

a decorative cross member having an upper back center sling rail and a lower back center sling rail, the upper back center sling rail configured to forceably receive the first rod and the first terminating loop of the first fabric panel and the lower back center sling rail configured to forceably receive the first rod and the first terminating loop of the second fabric panel;

an upper back cross member having a back top sling rail with an interior side configured to slidably receive the second rod and the second terminating loop of the first fabric panel wherein the back top sling rail is separate from the upper back cross member and configured to securely attach to the upper back cross member to form a section of a back rest; and a lower back cross member having a lower back sling rail having an interior side configured to slidably receive the second rod and the second terminating loop of the second fabric panel wherein the lower back sling rail is separate from the lower back cross member and configured to securely attach to the lower back cross member forming another section of the back rest.

2. The double sling chair of claim 1, wherein the upper back cross member is configured with screw threads and receives a screw that secures the back top sling rail to the upper back cross member of the chair frame.

3. The double sling chair of claim 2, wherein the first fabric back panel is tensioned as the screw is tightened against the upper cross member.

4. The double sling chair of claim 1, wherein the lower back cross member is configured with screw thread and receives a screw that secures the lower back sling rail to the lower back cross member of the chair frame.

5. The double sling chair of claim 4, wherein the second fabric back panel is tensioned as the screw is tightened against the lower back cross member.

6. A sling chair comprising:

a chair frame having a back section with an upper back cross member, a decorative cross member, a lower back cross member and a seat section;

a seat panel coupled to the seat section of the chair frame;

a first fabric back panel having length and first and second terminating loops at opposing ends with a first rod fitting inside the first terminating loop and a second rod fitting inside the second terminating loop;

a second fabric back panel having length and first and second terminating loops at opposing ends with a first rod fitting inside the first terminating loop and a second rod fitting inside the second terminating loop;

the decorative cross member having an upper back center sling rail and a lower back center sling rail, the upper back center sling rail configured to press fit the first rod and the first terminating loop of the first fabric panel into an interior side of the upper back center sling rail and the lower back center sling rail configured to press fit the first rod and the first terminating loop of the second fabric panel into an interior side of the lower back center sling rail;

the upper back cross member having a back top sling rail with an interior side configured to fit the second rod and the second terminating loop of the first fabric back panel into the interior side of the back top sling rail wherein the back top sling rail is attached to the upper back cross member of the chair frame to form a section of a back rest for the back section; and a lower back cross member having a lower back sling rail having an interior side configured to fit the second rod and the second terminating loop of the second fabric back panel into the interior side of the lower back sling rail wherein the lower rail is attached to the lower back cross member of the chair frame to form another section of the back rest for the back section.

7. The sling chair of claim 6, wherein the upper back cross member is configured with screw threads to receive a screw to secure the back top sling rail to the upper cross member of the chair frame.

8. The sling chair of claim 6, wherein the lower back cross member is configured with screw threads to receive a screw to secure the lower back sling rail to the lower back cross member of the chair frame.

9. The sling chair of claim 8 wherein the second fabric back panel is tensioned as the screw is tightened against the lower back cross member.

* * * * *